US006578724B1

(12) United States Patent
Owens

(10) Patent No.: US 6,578,724 B1
(45) Date of Patent: Jun. 17, 2003

(54) CONNECTOR FOR USE IN PACKAGING AEROSOL CONTAINERS

(75) Inventor: Edward F. Owens, Ellicott City, MD (US)

(73) Assignee: United States Can Company, Lombard, IL (US)

( * ) Notice: Subject to any disclaimer, the term of this patent is extended or adjusted under 35 U.S.C. 154(b) by 0 days.

(21) Appl. No.: 10/040,846

(22) Filed: Dec. 29, 2001

(51) Int. Cl.[7] ..... B65D 21/032
(52) U.S. Cl. ..... 220/23.6; 206/821
(58) Field of Search ..... 220/23.6, 23.4; 206/821, 503

(56) References Cited

U.S. PATENT DOCUMENTS

| | | | | | |
|---|---|---|---|---|---|
| 2,687,231 | A | * | 8/1954 | Somers | 206/503 |
| 3,885,672 | A | * | 5/1975 | Westenrieder | 206/503 |
| 4,308,952 | A | * | 1/1982 | Paulucci | 206/216 |
| 4,469,252 | A | | 9/1984 | Obrist | |
| 6,142,330 | A | * | 11/2000 | Sacks | 206/503 |

FOREIGN PATENT DOCUMENTS

JP 11-301757 A * 11/1999

* cited by examiner

*Primary Examiner*—Stephen Castellano
(74) *Attorney, Agent, or Firm*—Polster, Lieder, Woodruff & Lucchesi, L.C.

(57) ABSTRACT

A connector (10) used in packaging together two aerosol containers (A1, A2) for sale as a unit. A first connector segment (12) attaches to one aerosol container (A1), and a second connector segment (14) attaches to the other aerosol containers (A2). The connector segments grasp adjacent portions of the respective aerosol containers which, in one embodiment are stacked vertically, one above the other, and in other embodiments horizontally in a side-by-side configuration. In two of the embodiments, the connector is formed as a one piece, integral connector. In a third embodiment, the connector segments are separate pieces (12C and 14C) with one piece (12C) attaching to the top, cap portion of the containers, and the other piece (14C) attaching to the base of the respective containers. In each embodiment the containers are handled as a single unit regardless of whether one container or the other, or the connector, is used to move the containers.

9 Claims, 6 Drawing Sheets

CONNECTOR FOR USE IN PACKAGING AEROSOL CONTAINERS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to aerosol containers, and more particularly, to a connector for packaging two or more containers together so the resultant package is available for retail sale as a single unit.

Aerosol containers come in standard sizes and their contents are used for many purposes. Typically, aerosol containers are sold as a single unit. Sometimes, however, it is desirable to sell two containers together at a retail outlet. As a matter of convenience, rather than having the customer pick two individual containers off the shelf, it is desirable if the containers were packaged as a single unit. The present invention teaches various connectors for joining at least two aerosol containers together so they can be sold as a unit.

It is known to connect containers together so they can be sold as a unit. Two liter soda bottles are packaged together as a two pack. Beer and soda cans and bottles are packaged together, usually as a six pack. The two liter packaging consists, for example, of a plastic handle having extensions which fit over the top of each liter bottle and grasp the bottle about its neck. When carried, the bottles hang suspended from the handle. The six packs typically have two rows, side-by-side, of three plastic loops which fit tightly about the side of the bottle or can somewhere below the top of the bottle or can. Aerosol containers present a different packaging problem from these tops of bottles or cans. For one thing, the containers are smaller than the two liter bottles. Second, aerosol containers have a removable cap which is replaced after contents of the container are dispensed. This is because all the contents of the aerosol container are usually not dispensed at one time. Accordingly, it is important that the containers be so handled that the cap is not displaced during handling. On the other hand, when a beer or soda bottle or can is opened, the contents are usually consumed in a very short period of time. Finally, regardless of whether cans or bottles are packaged together, they are arranged in a side-by-side, horizontal arrangement. With some aerosol containers, it is desirable to package them vertically.

It is also known to package two or more containers together using a shrink wrap or the like. However, once this wrapping is torn apart, the container must be handled and stored as separate units. It is a feature of the present invention that the connectors enable the container to be kept together, even if one of the units is being used.

BRIEF SUMMARY OF THE INVENTION

Among the several objects of the present invention may be noted the provision of a connector for use in attaching at least two aerosol containers together so they can be sold as a unit. The containers can dispense the same or different products. One type of connector allows the aerosol containers to be connected together one above the other; while the other connectors allow the containers to be connected together side-by-side. Graphics can be printed on a portion of the connectors advertising the name of the product manufacturer, product information, sales price, etc. The connectors are made of a plastic material which holds the containers together as a unit both for sale and storage, but which allows an individual container to be readily removed. The connector is lightweight, low cost, allows easy assembly of a two container package, and is disposable.

In accordance with the invention, generally stated, a connector is used in packaging together two aerosol containers for sale as a unit. A first connector segment attaches to one aerosol container, and a second connector segment attaches to the other aerosol containers. The connector segments grasp adjacent portions of the respective aerosol containers which, in one embodiment are stacked vertically, one above the other, and in other embodiments horizontally in a side-by-side configuration. In two of the embodiments, the connector is formed as a one piece, integral connector. In a third embodiment, the connector segments are separate pieces with one piece attaching to the top, cap portion of the containers, and the other piece attaching to the base of the respective containers. In each embodiment the containers are handled as a single unit regardless of whether one container or the other, or the connector, is used to move the containers. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1A:
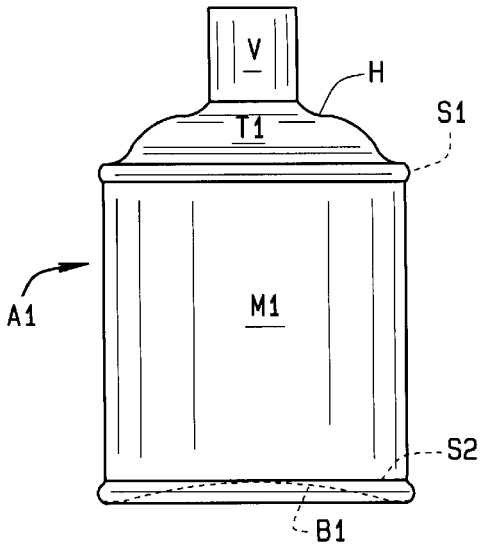
FIG. 1A is an elevational view of a first type aerosol container which can be packaged in a stacked, vertical configuration or in a side-by-side, horizontal configuration.

Referring to the drawings, a connector for use in packaging at least two aerosol containers together for sale of the containers as a unit is indicated generally 10A–10F in the respective drawings. As shown in FIG. 1A, a first type of aerosol container A1 has a generally cylindrical center section M1, a top section T1 attached to an upper end of the center section, and a base section or countersink B1 attached to a lower end of the center section. As is well-known in the art, circumferentially extending seams, S1 and S2 respectively, are formed at each end of section M1 where the other two sections are joined to the center section. A fluid dispensing valve V is fitted into the top section T1 of the container. A cap (not shown) may be sized to fit over the valve and seat on a shoulder formed in the top section of the container.

Figure 1B:
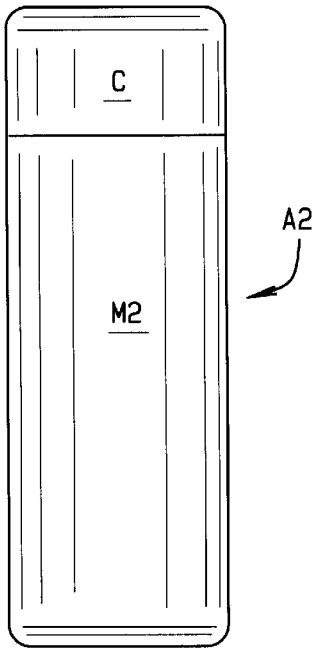
FIG. 1B is an elevational view of a second type aerosol container which can be packaged in a side-by-side horizontal configuration.

Another aerosol container construction is shown in FIG. 1B. This aerosol container A2 includes a center section M2 together with top and bottom sections (not shown). A fluid dispensing valve (also not shown) is again fitted to the top section of the valve. A removable cap C fits over the top of the container. With respect to containers A1 and A2, their sizes shown in the drawings are representative only. Further, the size and construction of the containers form no part of this invention.

Figure 2:
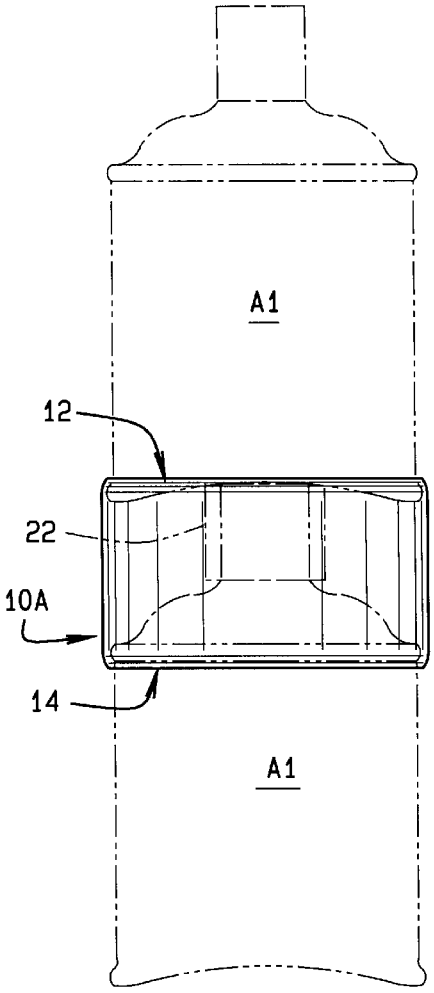
FIG. 2 is an elevational view of a first embodiment of the invention for stacking two containers vertically.
Figure 3A:
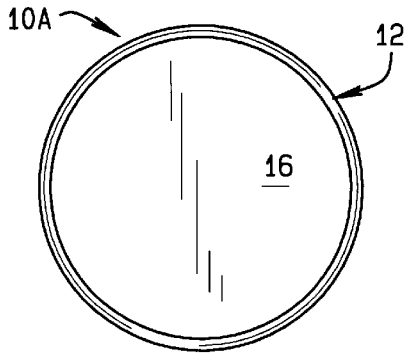
FIG. 3A is a top plan view of the connector of FIG. 2.
Figure 3B:
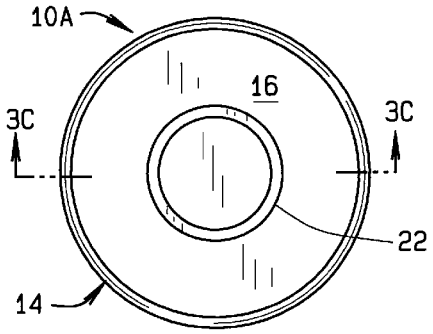
FIG. 3B is a bottom plan view of the connector.
Figure 3C:
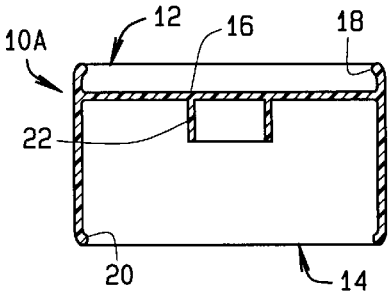
FIG. 3C is a sectional view of the connector taken along line 3C—3C in FIG. 3B.
Figure 5B:
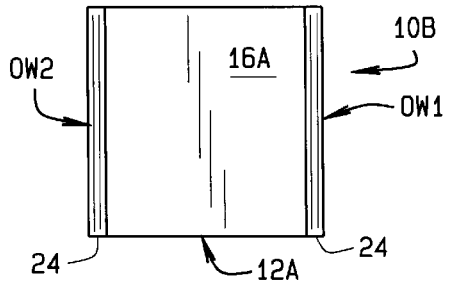
FIG. 5B is an end elevational view of the connector.

With respect now to FIGS. 2–3C, a first embodiment 10A of connector 10 is for use in connecting together aerosol containers when the containers are stacked vertically, one above the other. Connector 10A includes a first connector segment 12 which attaches the upper aerosol container A1 in the stack, and a second connector segment 14 which attaches to the lower of the two aerosol containers. The two connector segments grasp adjacent portions of the vertically stacked containers and hold them together. This allows the two containers to be handled as a single unit.

Connector 10A is formed as a one piece, integral connector in which the two connector segments are joined together to form a unitary connector. The connector is preferably made of a flexible, plastic material. As shown in the views of FIGS. 3A–3C, connector 10A has a generally circular cross-section with the inner diameter of the connector corresponding to the outer diameter of the aerosol containers. A common wall 16 defines the base of connector segment 12 and the upper end of connector segment 14. The height of segment 12 is less than the height of segment 14, and the outer end of each segment is open so to fit about a portion of the two aerosols containers packaged together.

When the connector is used to package the containers together, the open, mouth end of first connector segment 12 fits about the seam S2 formed at the lower end of the upper aerosol container in the stack. The second connector segment 14 attaches to the seam S1 formed at the upper end of the lower aerosol container in the stack. As best shown in FIG. 3C, the mouth end of each connector segment curls inwardly as indicated at 18 and 20 respectively. Thus, when segment 12 is attached to the upper container in the stack, curl 18 fits over the lower end of the container about seam S2. Similarly, when segment 14 is attached to the lower container in the stack, curl 20 fits over the upper end of the container about seam S1. As noted above, the aerosol containers S1 include a fluid dispensing valve V fitted into its top section T1. Second container segment 14 includes an annular skirt 22 which descends from the wall 16 dividing the upper and lower connector segments. The inner diameter of skirt 22 is slightly larger than the diameter of the dispensing valve. Skirt 22 is concentrically formed with the lower segment and depends from wall 16 a distance corresponding to the height of the dispensing valve. The skirt is lowered over the dispensing valve as connector segment 14 is fitted onto the lower container in the stack. When installed, the skirt provides stability to the resulting package.

Figure 4:
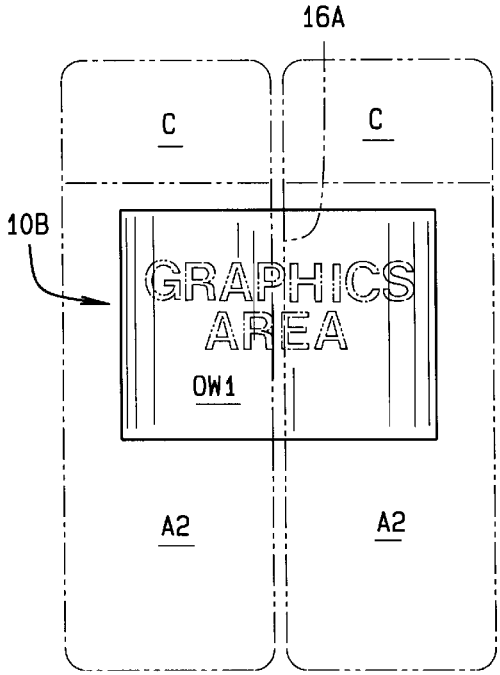
FIG. 4 is an elevational view of a second embodiment of the invention for packaging containers side-by-side.
Figure 5A:
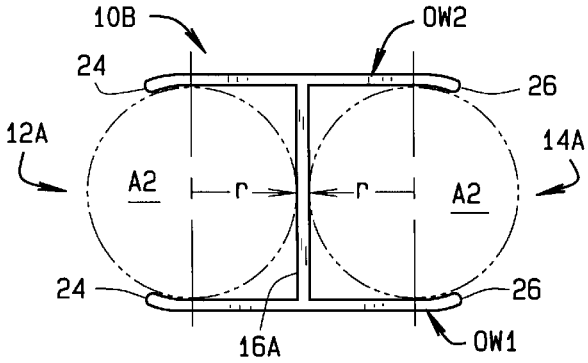
FIG. 5A is a plan view of the connector of FIG. 4.
Figure 5D:
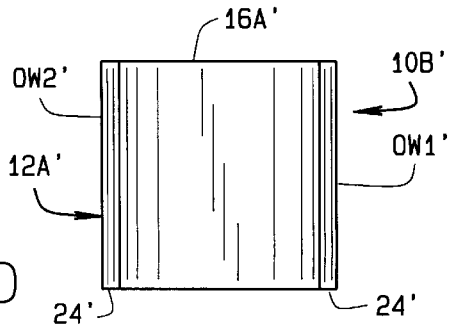
FIGS. 5C and 5D are respective plan and end elevational views of an alternate construction of the second embodiment of the connector.

Referring to FIGS. 4–5D, a second embodiment of connector 10 is indicated 10B and 10B'. This embodiment of the connector is for packaging aerosol containers A2 in a side-by-side, horizontal relationship. The second embodiment of the connector also includes a first connector segment 12A which attaches to a first of the aerosol containers, and a second connector segment 14A which attaches to a second of the aerosol containers. Again, the connector is a one piece, integrally formed connector including a common wall 16A joining the two connector segments together to form a unitary connector. In FIG. 5A, wall 16A is shown to be a straight, vertical wall extending from one side of the connector to the other. The width of the wall corresponds to the diameter of the aerosol containers A2. The remainder of the segments 12A and 14A are formed by sidewalls OW1 and OW2 which extend perpendicular to wall 16A at each end of the wall. The resulting connector segments are generally U-shaped as shown in FIG. 5A. Further, the length of the sidewall sections forming the respective connector segments is each greater than a radius r of the aerosol containers A2. This is as shown in FIG. 5A. Each end of the sidewalls curl inwardly as indicated at 24 (for connector segment 12A) and 26 (for the other connector segment) respectively. When the connector is to be attached to aerosol containers to create a package, the open end of each connector segment is pushed against the container sidewall. The sidewalls of the connector segment spread apart until the outer, curled end of the segment slides past the center of the container. Since the depth of the segment is greater than the radius of the container, once the outer end of the segment extends "over center", the segment will hold the container in place.

As shown in FIG. 4, the sidewalls OW1 and OW2 of the connector comprise a generally flat, rectangular graphics area on which text and artwork can be printed. Or, a label (not shown) having text and artwork can be applied to this area. Since there is a similar graphics area on each side of the connector, the graphics or label can be located on both sides of the connector.

Figure 5C:
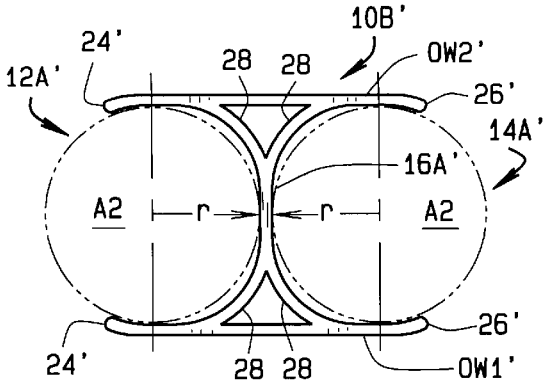

In FIGS. 5C and 5D, connector 10B' is shown to be similar to connector 10B. However, in this alternate embodiment of the connector, the respective connector segments 12A' and 14A' have a curved shape whose curvature generally corresponds to that of the aerosol containers A2. Now, wall 16A' is not a common wall extending across the width of the connector, but rather comprises a common wall extending only partially across the width of the connector. The sidewalls forming the connector are again continuous, flat wall sections extending the length of the connector. The length of each sidewall section forming one of the connector segments is again greater than the radius of the container packaged by the connector; and, the ends of the sidewalls are inwardly turned as indicated at 24' and 26'. As with connector 10B, these sections provide a graphics area for text and artwork, or the application of labels. Connector 10B' now includes arcuate sections 28 extending between the common wall section 16A' and the sidewalls OW1' and OW2'.

Attachment of the connector segments to the aerosol containers is as described above. That is, once the outer end of the segment extends past the centerline of a container, the segment will hold the container in place.

Figure 7A:
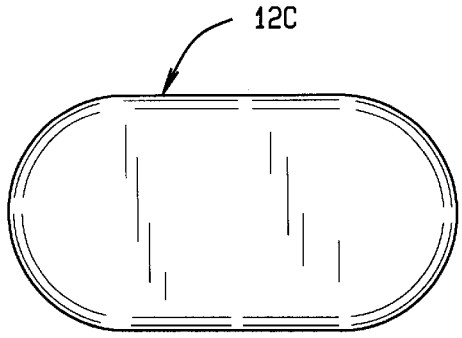
FIG. 7 is a top plan view of the upper segment comprising the connector of FIG. 6.
FIG. 7B is a bottom plan view of the connector segment.
FIGS. 7C and 7D are views similar to FIGS. 7A and 7B for the lower segment of the connector of FIG. 6.
Figure 7B:
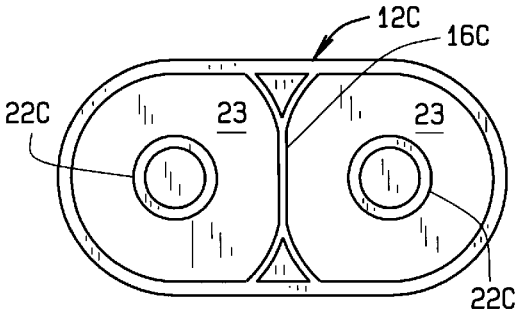
Figure 6:
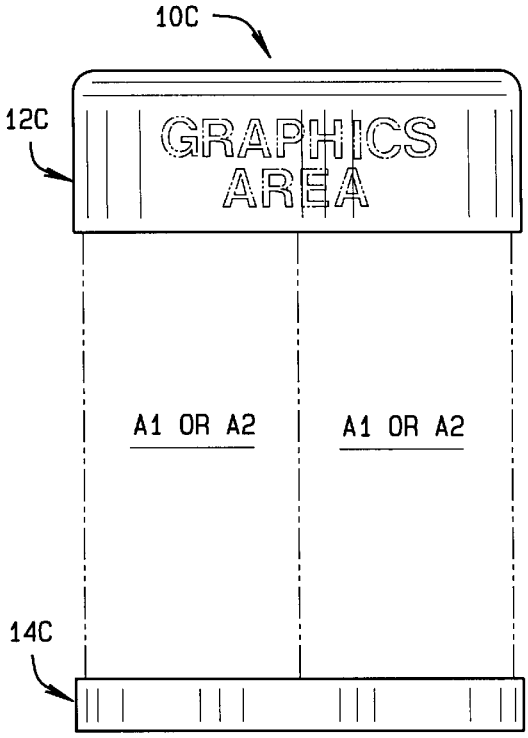
FIG. 6 is an elevational view of a third embodiment of the invention for packaging containers side-by-side.
Figure 7C:
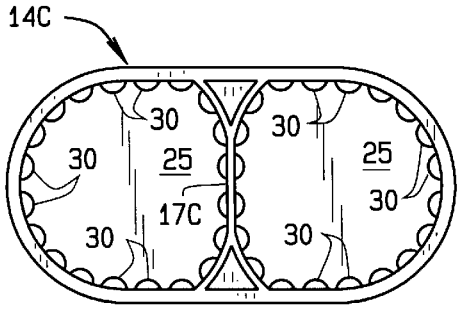
Figure 7D:
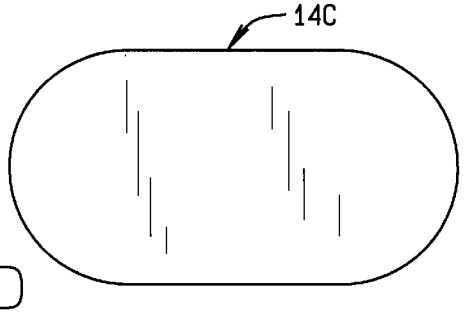

Referring now to FIGS. 6–7D, a third embodiment of connector 10 comprises a connector 10C. Connector 10C is formed as single piece, molded connector having two segments 12C and 14C which are separated from each other when two aerosol containers are to be packaged together for sale as a single unit.

The two connector segments each comprise an elongate cover piece the sides of which extend parallel to each other and the ends of which are rounded. The length of the connector segment 12C corresponds to twice the diameter of an aerosol container at the cap C or top end of the container. The length of the connector segment 14C corresponds to twice the diameter of the aerosol container at the base or bottom end of the container. The width of both connector segments corresponds to the diameter of the aerosol containers packaged using connector 10C. The rounded ends of each connector segment have a radius corresponding to the radius of an aerosol container. Each connector further has a circumferentially extending sidewall of uniform thickness.

As shown in FIG. 7B, an interior wall 16C, common to both of the packaged aerosol containers, is integrally formed on the inside of segment 12C. Wall 16C is similar to the wall 16A' previously described with respect to embodiment 10B' of the invention, and divides the segment into two separate compartments, one for each aerosol container to be packaged using connector 10C. The diameter of the cavity formed by the sidewall of connector segment 12C and wall 16C corresponds to the diameter of a packaged aerosol container. Further, a pair of annular skirts 22C is formed on the inside of the upper, end wall 23 of segment 12C. Each skirt 22C depends from wall 23 with the inner diameter of each skirt being slightly larger than the diameter of a dispensing valve of an aerosol container A1 packaged using connector 10C. Each skirt 22C is concentrically formed within a respective half of segment 12C, the skirt depending from wall 23 a distance corresponding to the height of the dispensing valve. The skirt is lowered over the dispensing valve as connector segment 12C is fitted onto the aerosol containers. Those skilled in the art will understand that if aerosol containers A2 are packaged using connector 10C, connector segment 12C will not include the skirts.

The height of connector segment 12C at least corresponds to the height of the cap C of an aerosol container A2 packaged using connector 10C. The height of segment 14C is substantially less than the height of segment 12C. The sidewall of connector segment 12C, along the sides of the segment, provides a graphics area on which text and graphic materials can be printed, or to which a label can be affixed. Other product information can be imprinted on the top of segment 12C, as well as on the sidewall and base of connector segment 14C.

Referring to FIG. 7C, the interior of connector segment 14C is similarly formed to segment 12C. Segment 14C includes an interior wall 17C identically formed to interior wall 16C and extending upwardly from a base wall 25 of segment 14C. Again, the interior wall divides the connector segment into separate compartments for housing the base of the aerosol containers packaged with the connector. The diameter of the cavity formed by the sidewall of connector segment 14C and wall 17C corresponds to the diameter of a packaged aerosol container. A series of spaced projections 30 are formed about the inner face of the sidewall of connector segment 14C as shown in FIG. 7C. These projections are formed slightly above base wall 25 of the connector segment and are used to secure the connector segment to the base of an aerosol container. That is, when the connector segment is installed over the bottom of the containers being packaged, the lower seal end or lip formed at the base of the center section of an aerosol container (such as the container A1 shown in FIG. 1A) rests between the projections and base wall 25. The projections now compress against the sidewall of the container and help hold the container and connector segment together. Even if an aerosol container A2 not having a lower lip is packaged using connector 10C, the projections still compress against the sidewall of the container and help hold the container and connector segment together.

Figure 8:
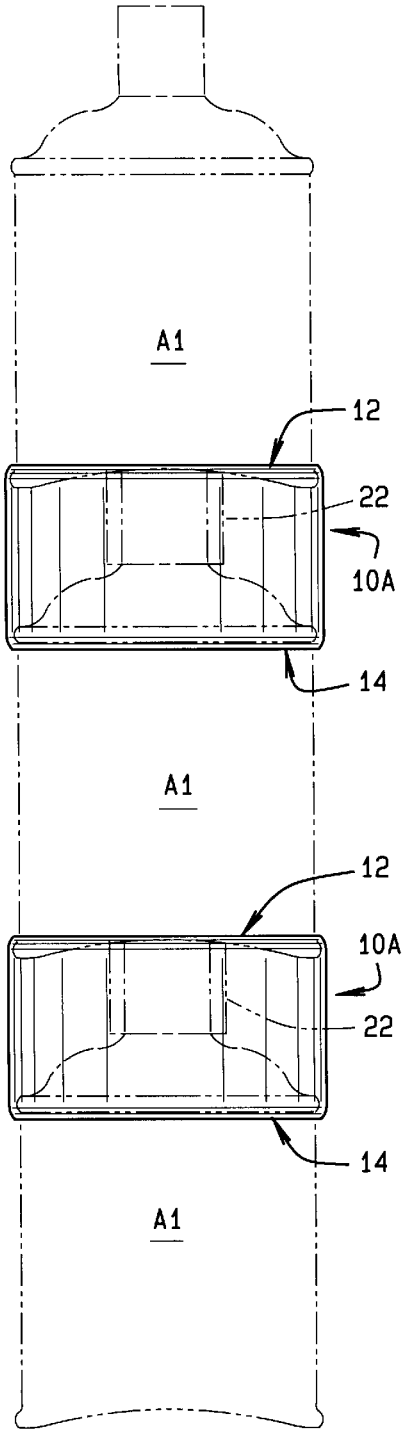
FIG. 8 is an elevational view of a vertical, stacked configuration of three containers using the connector of FIG. 2.

In addition to the above described embodiments, other embodiments, or combinations of embodiments can be used in packaging multiple aerosol containers into a single unit or product package. In FIG. 8, for example, two connectors 10A are used to create a product stack comprising three aerosol containers A1. Such a stack may be impractical if the containers A1 are tall, but may be a very efficient way of packaging the containers if they are short.

Figure 9:
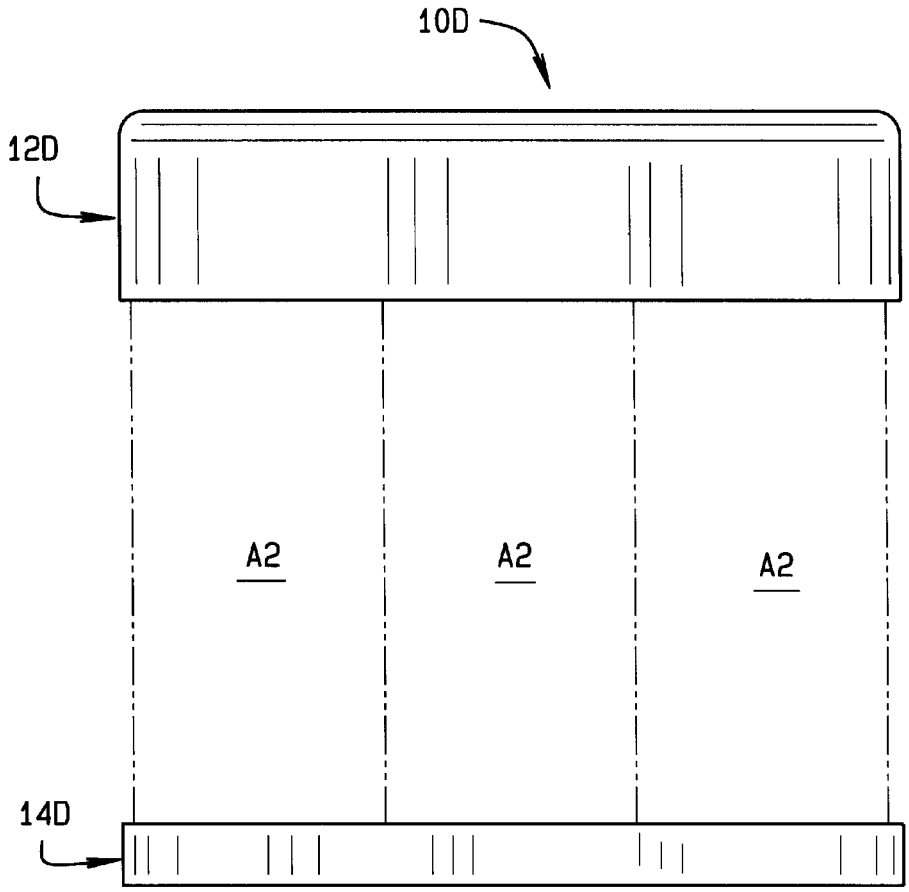
FIG. 9 is an elevational view of three packaged containers arranged side-by-side using the connectors of FIG. 6.

In FIG. 9, a connector 10D comprises connector segments 12D and 14D. These segments are similar to the segments 12C and 14C previously described, but are used to package three aerosol containers A2 in a side-a-side configuration rather than the two containers packaged using embodiment 10C. Each connector segment 12D and 14D includes two interior walls (not shown), such as the respective walls 16C or 17C. These interior walls are formed intermediate the length of each connector segment, and divide each connector segment into separate compartments for each of the three aerosol containers packaged using the connector. Further, if connector 10D is used to package aerosol containers Al, respective annular skirts (not shown) similar to the skirts 22C previously described are centrally formed within the compartment for housing the upper end of the aerosol container, each skirt fitting about a dispensing valve of the container.

Figure 10:
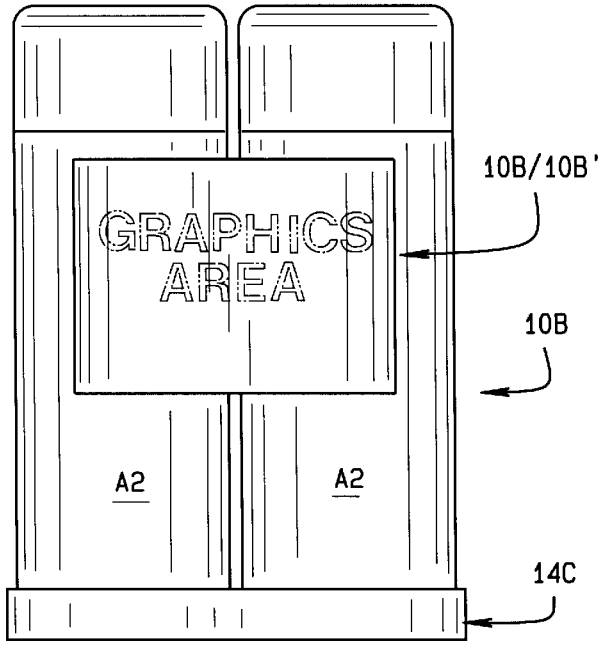
FIG. 10 is an elevational view of two packaged containers arranged side-by-side using the connectors of FIGS. 4 and 6; and, FIG. 11 is an elevational view of two vertically stacked containers which are packaged bottom end to bottom end.

Next, as shown in FIG. 10, a connector arrangement 10E is shown for use in packaging two aerosol containers A2 in a side-by-side arrangement. This connector arrangement employs both a connector 10B or 10B' formed as previously described, and a connector segment 14C, also as previously described.

Figure 11:
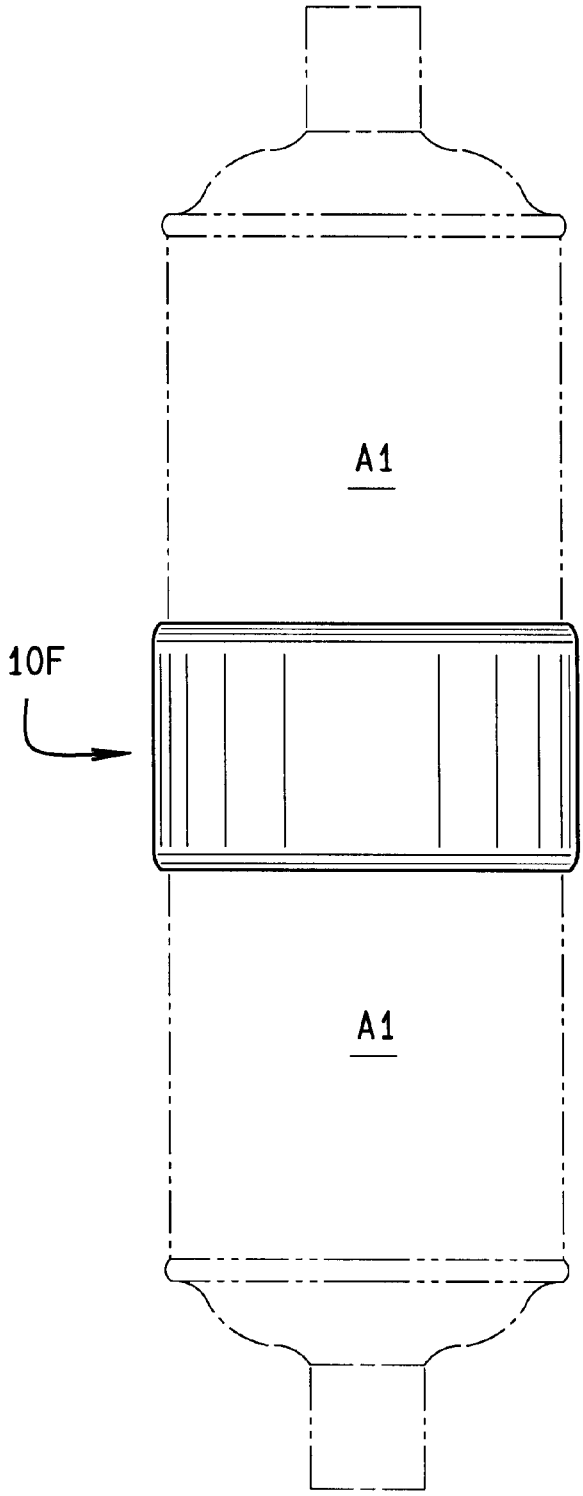

Finally, referring to FIG. 11, a connector arrangement 10F is shown for use in packaging two aerosol containers A1 in a bottom-to-bottom arrangement. The construction of this connector is similar to that of connector 10A, with both ends of the connector (i.e., the top and bottom ends of the connector) being formed the same as connector segment 12 of connector 10A. This allows the bottom ends of the respective aerosol containers A1 to be packaged in the connector.

What has been described are various embodiments of a connector for attaching at least two aerosol containers together so they can be sold as a unit. Those skilled in the art will understand that the containers A1 and A2 can dispense the same or different products. Thus, containers for different products (usually complementary) can be packaged together, as well two or more containers of the same product. One type of connector allows the aerosol containers to be packaged together one above the other; while other connectors allow the containers to be packaged together side-by-side. Graphics can be printed on a portion of the connectors advertising the name of the product manufacturer, product information, sales price, etc. The connectors are made of a plastic material which holds the containers together as a unit, but which allows an individual container to be removed. If desired, the units can be wrapped in a cellophane or clear plastic wrapping as well. The connectors comprise a lightweight, low cost, packaging which can be used on assembly lines to automate the packaging of two or more aerosol containers as a unit. Finally, the connectors are readily disposable after use.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

I claim:

1. A connector for use in packaging at least two aerosol containers together for sale of the containers as a unit, each aerosol container having a generally cylindrical center section, a top section attached to an upper end of the center section, a countersink attached to a lower end thereof, and a fluid dispensing valve fitted into the top section of each aerosol container, the connector comprising:

a first connector segment attached to a first of the aerosol containers; and, a second connector segment attached to a second of the aerosol containers, the two connector segments grasping adjacent portions of the respective aerosol containers when the containers are stacked vertically, one above the other for the containers to be handled as a single unit regardless of whether one container or the other, or the connector, is used to move the containers;

the first connector segment of the connector attached to a seam formed at the lower end of the upper aerosol container in the stack, the seam being formed where the countersink attaches to the lower end of the center section, the second connector segment attached to a seam formed at the upper end of the lower aerosol container in the stack, the seam being formed where the top section of the container attaches to the upper end of the center section thereof, and the second connector segment including an annular skirt sized to fit over and completely about the valve when the second connector segment is set in place to provide stability to the resulting unit.

2. The connector of claim 1 which is formed as a one piece, integral connector.

3. The connector of claim 2 further including means joining the two connector segments together to form a unitary connector.

4. The connector of claim 1 wherein each connector segment is cup shaped with the upper connector segment having a base forming a common wall with a top wall of the second connector segment.

5. The connector of claim 4 having an annular sidewall comprising the sidewall of both connector segments, the outer end of each connector segment being an open end so to fit about the respective aerosol containers.

6. The connector of claim 5 wherein the upper and lower ends of the sidewall curve inwardly so to fit about the respective seams in the aerosol containers to attach the connector to the containers.

7. The connector of claim 6 wherein the height of the first connector segment is shorter than the height of the second connector segment.

8. The connector of claim 4 wherein the skirt descends from the top wall of the second connector segment.

9. The connector of claim 7 further including a second connector for use in connecting together three aerosol containers in a vertical stack.

* * * * *